United States Patent [19]

Saunders

[11] Patent Number: 4,817,486

[45] Date of Patent: Apr. 4, 1989

[54] CONTROL SYSTEM WITH MEMORY FOR ELECTRIC GUITARS

[76] Inventor: John H. Saunders, 351 Orchard, Upland, Calif. 91786

[21] Appl. No.: 948,249

[22] Filed: Dec. 31, 1986

[51] Int. Cl.[4] ..... G10H 1/46; G10H 3/18

[52] U.S. Cl. ..... 84/1.15; 84/1.16; 84/1.27

[58] Field of Search ..... 84/1.01, 1.15, 1.24, 84/1.27, 1.16

[56] References Cited

U.S. PATENT DOCUMENTS 4,079,334 3/1978 Hamilton ..... 84/1.24

4,175,462 11/1979 Simon ..... 84/1.16

*Primary Examiner*—Stanley J. Witkowski

*Attorney, Agent, or Firm*—Boniard I. Brown

[57] ABSTRACT

A system for the selection and recall of individual phase, pickup selection, tone, overdrive and volume control for each of a plurality of pickup coils in electric guitars. These various controls for the humbucking pickup coils in the guitar are initially set by either rotary or toggle switches to achieve a particular combination of switch settings. Additional controls then allow the musician to write the states of these various controls into digital memory contained within the guitar. Several such combinations may be memorized and then recalled at a later time by actuation of a memory address selection switch which then reads the contents of the memory for a particular combination of settings and internally causes the various controls to reset themselves to this particular combination of settings.

14 Claims, 5 Drawing Sheets

CONTROL SYSTEM WITH MEMORY FOR ELECTRIC GUITARS

BACKGROUND OF THE INVENTION

This invention relates to systems for controlling the output characteristics of electric guitars having a self-contained memory which can recall and internally produce several different combinations of control switch settings. More particularly this invention relates to a system which can select and recall individual phase, pickup selection, tone, overdrive and volume control switch settings for humbucking or single pickup coils for electric guitars.

Most guitars have either single or dual (humbucking) coil pickups located at various points along the string length of the guitar. The position and characteristics of these individual pickups individually color the sound. Electric guitars, both regular and bass, can have a number of pickups usually ranging from one to three. A musician uses the individual volumes from each pickup to blend individual outputs from the combined pickups into a desired sound output mix. A pickup selector switch is usually also provided. Also a guitar may have either a main tone control for all of the pickups together or an individual tone control for each pickup and volume control.

With this multiplicity of controls it becomes difficult to rapidly change them during a performance when a different output sound from the guitar is required. Such changes may be required within a particular song or between songs when the musicial switches from playing a rhythm part to a lead part. Also a particular output sound mix may be preferred in a certain studio or club as opposed to another location.

With normal guitars without a memory function, it is almost impossible to quickly change between these different combinations of control settings to produce precisely the output sound mixes required. What has been needed is some sort of memory system to recall and reset internally the control switches in the guitar to achieve these particular combinations of switch settings. One such attempt in the prior art is that found in U.S. Pat. No. 4,175,462 which issued to Jonathan Simon on Nov. 27, 1979 for "System for Selection and Phase Control of Humbucking Coils in Guitar Pickups." This early memory control system has the ability to memorize and recall and reset switches which control the output volume in only a linear mode and phase of humbucking coils in electric guitars. However the system does not appear to be self-contained readily within the guitar itself and the implementation of the phase control circuitry is flawed. There has remained a need for a memory control system which can memorize all of the normal switch controls utilized on an electric guitar which is self-contained on the guitar and utilizes control switches which are familiar to and easily utilized by musicians.

SUMMARY OF THE INVENTION

This system controls the output characteristics from a plurality of pickups from an electric guitar. These pickups may be either single or humbucking electromagnetic pickups or they might also be electro-optical or piezoelectric pickups. The electric guitar is meant to include both the normal six-string electric guitar, bass electric guitars and other variations of this instrument. The system is self-contained on the guitar and comprises a plurality of switch means which are responsive to both manual and electronic actuation. These various switches control selection of individual pickups, volume and tone controls, overdrive switches, and phase selection switches. The system also comprises a digital memory control means which will recognize and store into its memory a plurality of different combinations of settings of the various switch means, will select and recall particular single combinations of switch settings, will cause the generation and transmission of electronic actuation signals to the various solid state control switches in order to reset them as necessary to achieve the particular recalled combination of settings, and will retain the contents of its memory for an extended period of time.

In a preferred embodiment, the system also includes means to alter the volume of the pickups in either a linear or non-linear (audio) manner. This is done by providing a plurality of resistors arrayed in a ladder which may be individually accessed in various combinations to precisely achieve a particular attenuation characteristic.

In another embodiment, the frequency and/or tonality characteristics of a particular humbucking coil may be precisely tailored by providing for either the disablement of one of the two individual electromagnetic pickups in a single humbucking coil or also by reversing the phase of the combined output of a single humbucking coil with respect to the other pickups on the guitar.

In a further preferred embodiment, precise control of the frequency characteristic of the output and the tone control is achieved by providing for a plurality of individually accessed capacitors arrayed in parallel.

In another preferred embodiment, the long-term retention of the contents of the memory is provided by having two different current states within the memory control circuitry. The first state is a full-power state in which the memory control is provided with all of its capabilities. In the standby, long-term state, a reduced current level is provided which serves only to store the signals contained within the memory.

The novel features that are considered characteristic of this invention are set forth with particularity in the appended claims. The invention will best be understood from the following description when read in conjunction with the accompanying drawings.

DETAILED DESCRIPTION OF THE INVENTION

Figure 1:
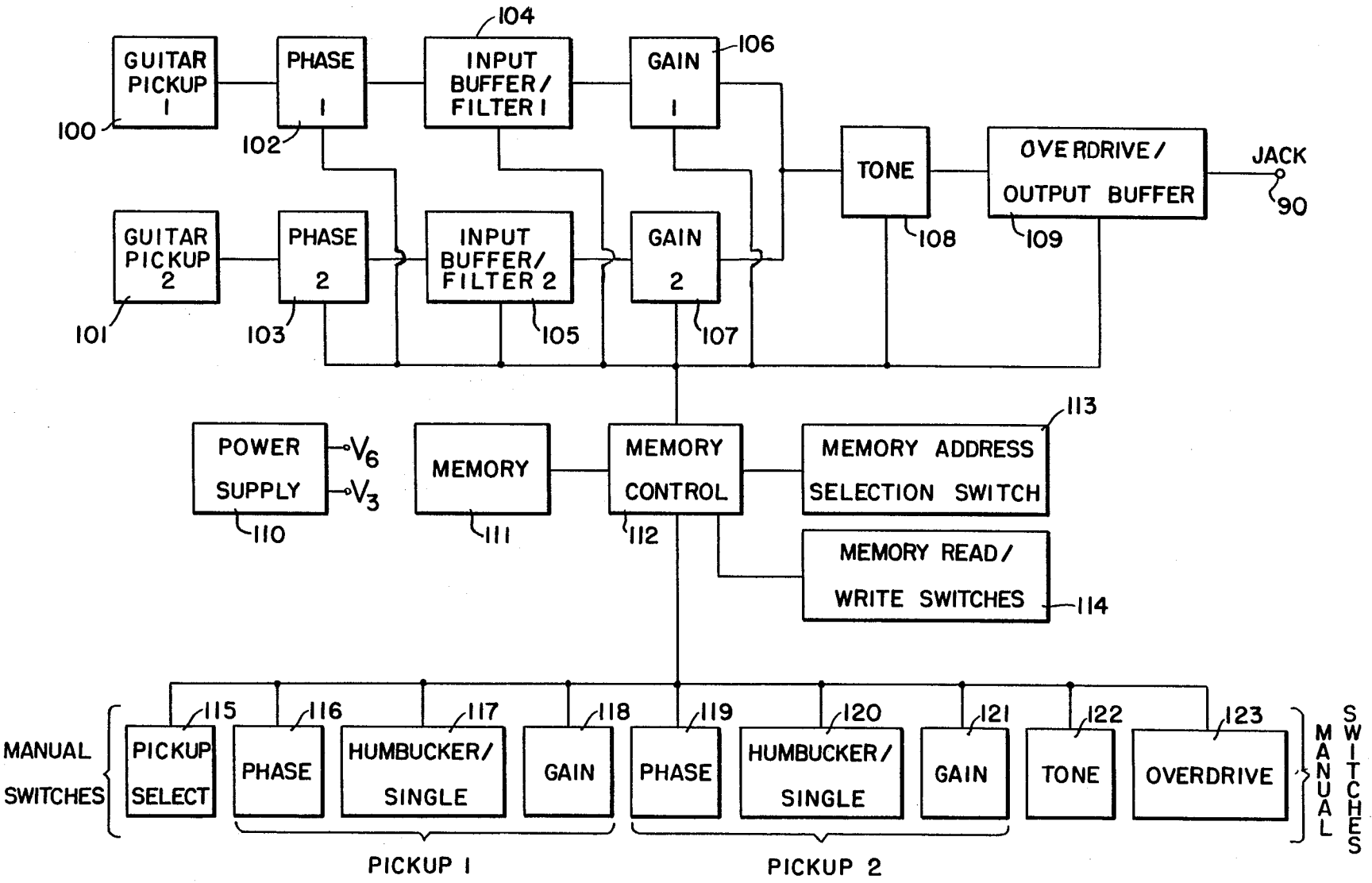
FIG. 1 is a schematic block diagram showing the various functional sections of the system of this invention.

Referring now to FIG. 1, this figure may be conveniently separated into three major subsections. At the bottom portion of the figure are the manual switches 115–123 which control the various functions as indicated. These are the typical switches which would be found on most electric guitars with the exception of the rotary BCD switches which act like normal controls. The central portion of the drawing figure shows the various memory control circuits 111–114 along with the power supply 110. In this section the memory address selection switch 113 is that switch which recalls the various combinations of switch settings from the memory 111. The memory read/write switch 114 controls the indicated functions of the memory 111. The remaining upper portion of the figure shows the various functional portions of the guitar itself along with the control circuits 102–109 which alter the various characteristics of the signals initially produced at the guitar pickups 100, 101 as indicated. Output to an external amplifier, not shown, is provided by the jack 90.

Figure 2:
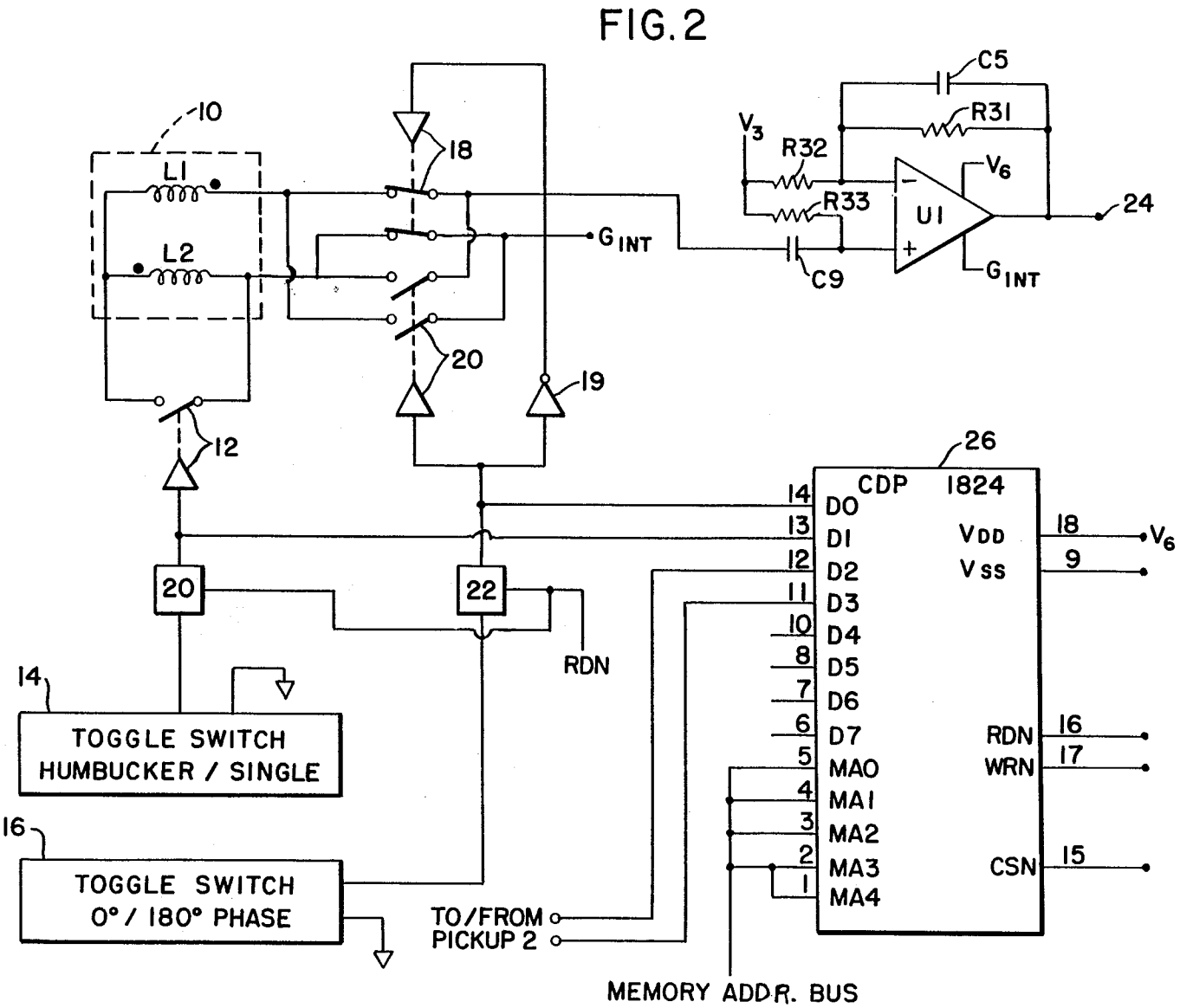
FIG. 2 is a detailed schematic showing a single humbucking pickup with its phase control circuitry, and its output passing through an initial operational amplifier in conjunction with a low pass filter.

FIG. 2 is a detailed layout of the guitar pickup, the phase control section, and the input buffer/filter section. An individual humbucking pickup 10 is shown in the upper left-hand portion of this figure. As shown a humbucking coil actually consists of two different coils L1 and L2 having reverse polarity as shown. The advantage of the humbucking coil of course is that the coil will tend to cancel random noises in the environment but will output the desired frequency signature of the guitar string. However is some instances it may be desirable to cancel one side of the dual coils. This is done by employing the switch 12 to cancel the coil L2 output. This can be done by the manual operation of the toggle switch 14 and may also be done under the control of the memory unit. The block 20 is a transfer gate. When it is enabled under the control of the memory chip by the signal RDN it will allow the passage of the output signal from the manual toggle switch 14 to be conducted to the switch driver 12. When the overall control system is under the control of the memory chip 26, the switch driver 12 will be controlled by the signal from the output data line D1 from the memory chip 26.

It may also be desirable to switch the phase of the combined output of the two coils L1 and L2 180°. This is done either by the manual toggle switch 16 or under the control of the memory chip 26. As before the output of the manual switch 16 can be passed through the transfer gate 22 when it is energized by the signal RDN. Otherwise the phase of the combined signal will be controlled by the data line D0 output from the memory chip 26. These signals control the operation of the switching network consisting of the two switches 18 and 20 and the inverter 19 as shown. The memory chip 26 is shown in detail in this figure since it will be repeated in less detail in succeeding figures. The various data lines D0–D7 are output over the lines which would be labelled on the chip (CDP 1824) itself as 14-6 respectively. The memory address lines MA0–MA4 are located at pins 5-1 on the chip itself as shown. These lines are combined into the memory address bus as shown in the figure. The other terminals are the $V_{DD}$ which is connected to the six-volt line of the power supply, the $V_{SS}$ line which is connected to the ground circuits in the system, the RDN line which enables various gates, the WRN line which enables the writing into the memory chip of the states of the various manual switches either 14 or 16 on this particular pickup or the corresponding switch positions for the pickup number 2, and finally the CSN line which is the chip select enable line for this particular memory chip. The output from the phase reversal switching network then passes through a low pass filter and the operational amplifier U1. This high impedance amplifier U1 serves as a buffer and its gain is determined by the ratio of R31/R32. A feedback capacitor C5 is provided to roll off undesirable high frequencies to prevent EMI feedback above 20 kilohertz. The output of this stage then passes off of this drawn figure at point 24 and onto FIG. 3 at point 24.

Figure 3:
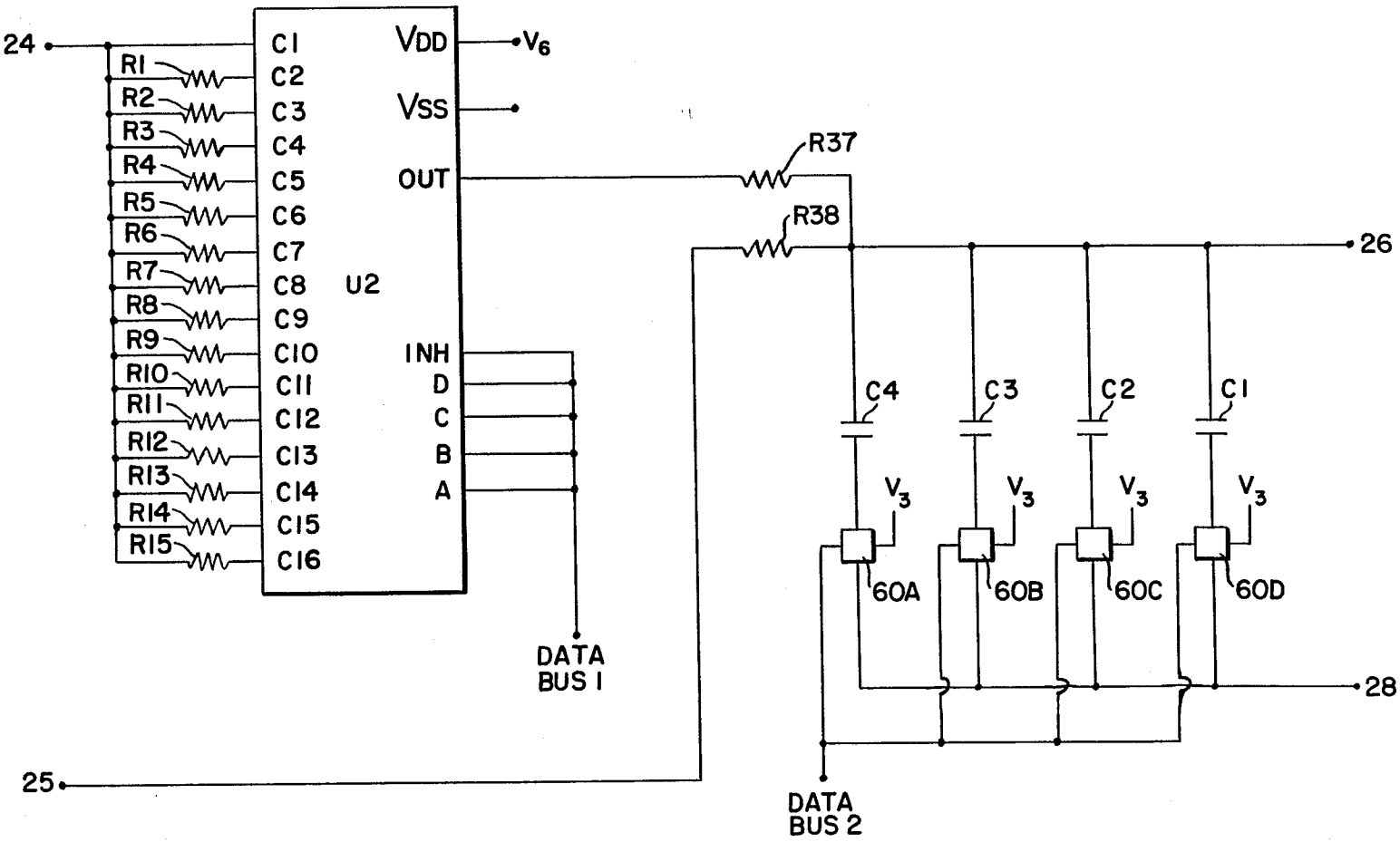
FIG. 3 is another detailed schematic drawing showing the output from FIG. 2 feeding through the resistance ladder and on into the tone control circuitry.

In FIG. 3, the output from FIG. 2 reenters at point 24 into a resistor ladder as shown. Resistors R1-R-15 are connected to the chip pin numbers C2–C16 respectively. Pin C1 has no resistor connected to it. The output of the ladder is controlled by the analog multiplexer chip U2. The various combinations of the resistors R-1R15 are controlled by the code input over data bus 1 into inputs A B C D into chip U2. The output of the chip can be disabled entirely by the presence of an inhibit signal on line INH. The output of this chip then passes through a resistor R37 where it is combined with the output from a similar chip from the second pickup coming in from point 25 and through its own resistor R38. These two signals then combine at point 27 and enter into the tone control circuit. The tone control circuit shown here is a combined tone control circuit which changes the frequency characteristic to combine signals from both of the pickup lines. This circuit could be employed individually for the output from each pickup, that is, a separate tone control circuit for each pickup. In any event, the combined output signal from point 27 then enters into the capacitor network as shown. The various capacitors C4, C3, C2, and C1 have their outputs controlled by the various transfer gates 60A, 60B, 60C and 60D, as shown. The operation of these transfer gates is controlled by signals from data bus 2. In a preferred embodiment this tone control is readily a low pass filter tone circuit which is binarily weighted. With C1 having the smallest capacitance, C2 having twice as much capacitance as C1, C3 four times as much capacitance as C1 in C4 having eight times as much as C1. When the gates are turned on in an ascending order with gate 60A being the most significant bit and 60D being the least significant bit, an increasing loss of high frequencies will be observed. The output from the tone control circuit is provided at points 26 and 28.

Figure 4:
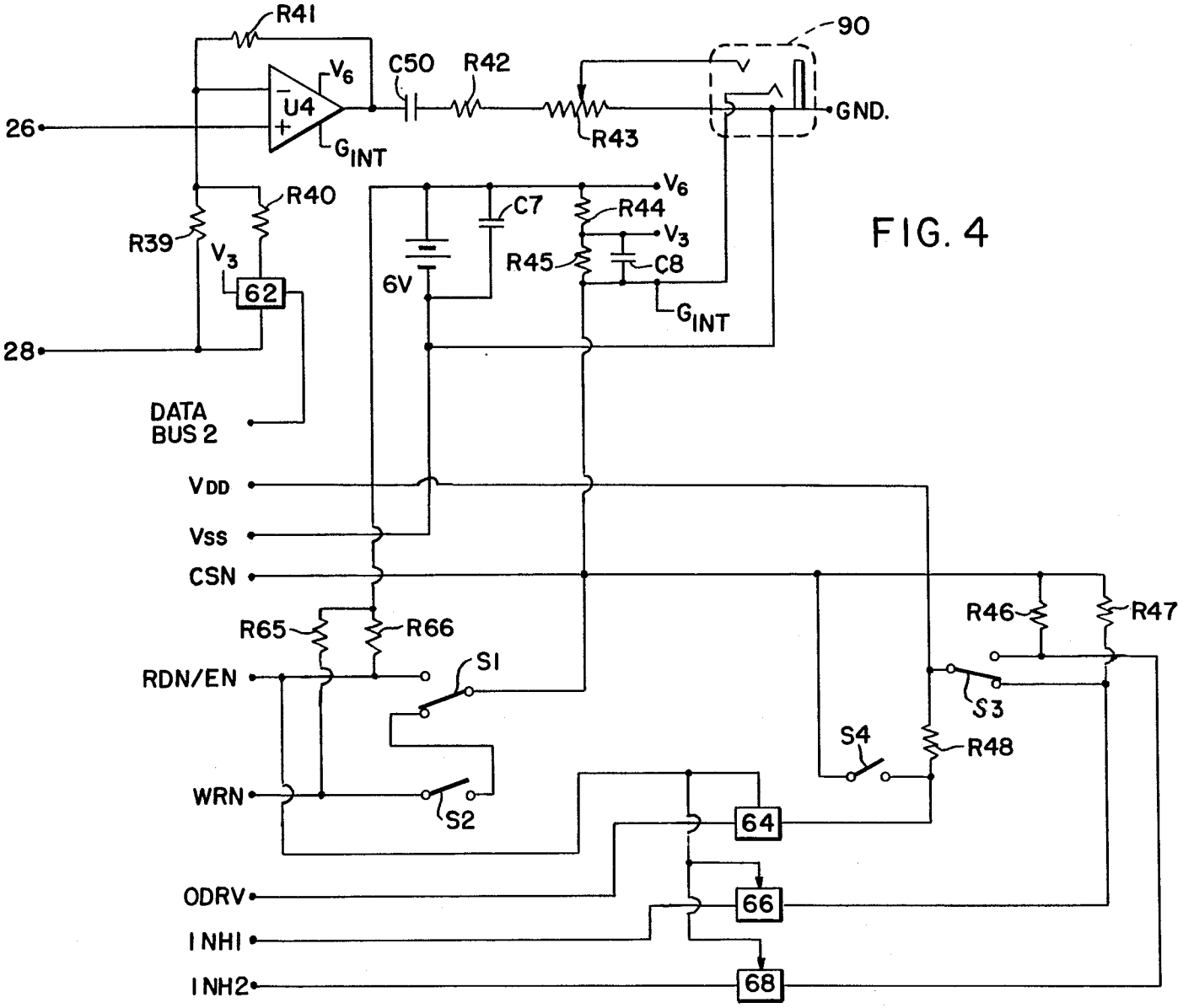
FIG. 4 is another detailed schematic drawing showing the output of FIG. 3 feeding into the overdrive circuit and eventually to the output jack of the system, also shown are the power supply and several of the switches on the guitar.

In FIG. 4 the output from FIG. 3 comes in an points 26 and 28, as shown. Signals enter into an output buffer amplifier circuit which is also modified to become an overdrive circuit. The output buffer amplifier U4 is used to isolate the output of the guitar from the capacitive load that the cable between the guitar and an external amplifier presents. The output buffer amplifier U4 can also have a varying gain to overdrive the front end of the external amplifier to produce harmonic distortion, a sometimes wanted effect. To change the gain of the output buffer amplifier a resistor R39 is added in parallel to the negative input resistor R40. This is gated by a transfer gate 62 under the control of the data bus 2. The output from here eventually passes to the output jack 90 as shown through capacitor C50 and bias resistor R42 and variable resistor R43, which controls the final output gain.

FIG. 4 also contains several switches. One of these switches is a three position pickup selector switch shown at S3. At S3 only two of the contacts are shown, with a third being a no contact position. At the no contact position, both pickups will be enabled, at either of the two positions shown at switch S3 in the drawing figure, one or the other of the pickups will be inhibited. The output from this switch passes through transfer gates 66 or 68 as shown. To select the overdrive function, a two position switch S4 is shown which controls the transfer gate 64. This ODRV output signal from S4 eventually makes it way back to transfer gate 62 over data bus 2 line. The gain at the overdrive circuit is defined by the relationship $R41/((R39 \times R40)/(R39+R40))$.

In this embodiment the memory circuit is powered by a six-volt battery as shown in this figure though it is not limited by such and could be run by an external single or dual voltage supply. A false ground (V3) is provided via resistor divider network R44 and R45 and is AC decoupled by capacitor C8. Their main supply of voltage is filtered by capacitor C7. The guitar memory circuit goes into a low power mode when the phone jack is unplugged from the output jack plug socket 90. Unplugging turns off all of the amplifiers and sets the memory circuits to a standby mode with the lower current level. Also shown in this figure are the memory read/write switch S1 and the memory write switch S2. Power for these switch signals is fed through bias resistors R65 and R66. To prevent a conflict of the data lines, the outputs of the binary coded decimal (BCD) volume and tone control switches shown in FIG. 5 and the three position pickup selector switch, the overdrive switch and the phase control switches are run through transfer gates which disconnect the switches when the memory is in a read condition.

Figure 5:
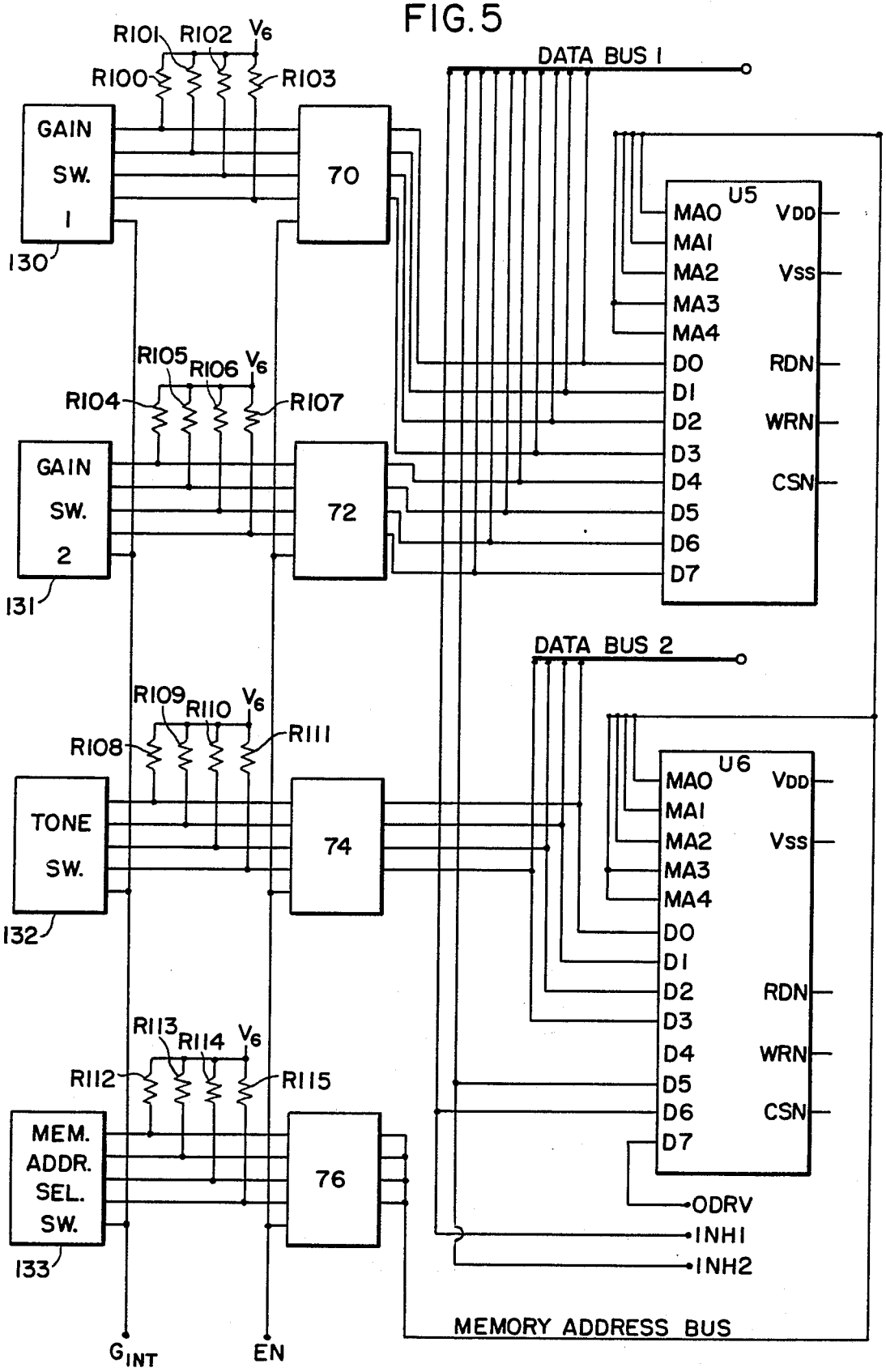
FIG. 5 is a further detailed schematic drawing showing several of the other switches, the memory chips, the memory address bus and the two data busses.

FIG. 5 is another detailed schematic drawing showing the connections for the various volume (gain) switches 130 and 131, the tone switch 132 and the memory address selection switch 133. The gates in the other drawings have already been identified, in FIG. 5 these transfer gates are shown in blocks 70, 72, 74 and 76. The gain switch 1 (130), the gain switch 2 (131), and the tone switch (132) as well as the memory address selection switch (133) shown on the left edge of FIG. 5 are implemented in this embodiment as BCD switches. However they could also be constructed as ordinary potentiometers coupled through analog to digital converters. In any event the outputs of these rotary switches in this figure are produced as digital signals which are conveyed through the transfer gates into the memory chips U5 and U6 as shown. Power for the operation of the gates 70, 72, 74 and 76 is provided by the $V_6$ voltage fed through the bias resistors R100–R115. The outputs of the two gain switches and the tone switch are also coupled to the data bus lines 1 and 2 as shown. The output of the memory address selection switch is conveyed over the memory address bus into the memory chips U5 (134) and U6 (135) as well as to chip 26 shown in FIG. 2. The address defined by a particular position on the memory address selection switch will cause the recall of the memorized switch positions resident at that particular address in the chip memories to the output over the various data lines which will then cause actuation as necessary of the various switch drivers. This occurs during a memory read operation. During a memory write operation, the memory address selector switch would normally be set to any desired position, the various manual switches would be set up to produce the desired output characteristic for the guitar, the memory write operation would be enabled, and the switch settings for all of the manual controls would then be memorized and written into the memory chips at that point. These switch positions could then be automatically recalled at any time upon selection of the memory address defined by that particular switch position on the memory address selector switch.

The above described control system provies important advantages over what has gone before in the art of electric guitars. Single or multiple tone controls can be individually programmed for a variety of different conditions. The battery operation and the low power standby mode provide a memory maintenance which is effective for long periods of time without connection to external power supplies. Individual volume controls are provided for each pickup and the positions of these controls are conveniently memorized and recalled. The various volume adjustments can be made to have either audio or linear tapers. Additionally, overdrive and pickup selection switches with attendant memory program/recall capabilities are provided. The volume, tone, memory address, overdrive and pickup selection switches can be readily implemented with the usual rotary switches which are familiar to musicians. The circuitry is set up so that write protection is provided when the guitar is unplugged. The low pass buffer/filter input operational amplifier to the pickups prevents spurious feedback in high power amplification usage and permits full harmonic spectrum output from the guitar pickup by presenting a high input impedance to the output of the guitar pickup.

Although particular embodiments of the invention have been described and illustrated herein, it is recognized that modifications and variations may readily occur to those skilled in the art. It is therefore intended that the claims be interpreted to cover such modifications and variations.

I claim:

1. A system for controlling the output of a plurality of pickups of an electric guitar, comprising:

a plurality of switch means responsive to both manual and electronic actuation which control the characteristics of the pickups including separate volume switches for each pickup wherein each volume switch comprises a multiple tap resistor ladder containing at least eight resistors selectably connected either individually or in combination by an analog multiplexer means such that the volume decibel level may be adjusted in non-linear increments, tone control switch means to control the frequency content of the output, overdrive switch means to enable the overloading of the input circuits of an external amplifier and phase switch means to control the phase of the outputs, and a digital memory control means comprising means to recognize and store in memory a plurality of different combinations of settings for the plurality of switch means, means to select and recall particular single combinations of switch settings, means to cause the generation and transmission of electronic actuation signals to the plurality of switch means to reset the switches as necessary to achieve the recalled combination of switch settings, and means to retain the contents of the memory for an extended period of time.

2. The system of claim 1 wherein the pickups are electromagnetic pickups.

3. The system of claim 2 wherein the pickups are humbucking pickups comprising two coils per pickup additionally comprising switch means to disable the output of one of the two coils in a single humbucking pickup.

4. The system of claim 2 wherein the pickups are humbucking pickups comprising two coils per pickup additionally comprising switch means to reverse the phase of the combined output of both of the two coils in a single humbucking pickup.

5. The system of claim 2 wherein the tone control switch means comprises a plurality of capacitors, each individually selectable, in a parallel array with the capacitance of one being about twice that of the next lower valued capacitor in the array.

6. The system of claim 2 wherein the digital memory control means additionally comprises memory read/-write switch means to select either a memory read operation for selection of a particular combination of switch settings or a memory write operation to store the states of the various switch means in the memory, a memory write switch means to enable the memory write operation, and a memory address switch means to select one of a plurality of switch setting combinations from the memory.

7. The system of claim 2 further comprising an internal power supply means which has at least two different current levels, one being a high level which is enabled only when an output jack plug socket of the electric guitar is connected to an external plug, said high level enabling the electronic actuation of the various switch means and memory storage and recall operations, and the other being a standby power level which is enabled when the output jack plug socket is disconnected, said standby power level enabling only the maintenance of the contents of the memory.

8. A system for controlling the output of a plurality of electromagnetic humbucking pickups comprising two coils per pickup of an electric guitar comprising:

a plurality of switch means responsive to both manual and electronic actuation which control the characteristics of the pickups including separate volume switches for each pickup wherein each volume switch coprises a multiple tap resistor ladder containing at least eight resistors selectably connected either individually or in combination by an analog multiplexer means such that the volume decibel level may be adjusted in non-linear increments, tone control switch means to control the frequency content of the output, overdrive switch means to enable the overloading of the input circuits of an external amplifier, switch means to disable the output of one of the two coils in a single humbucking pickup and switch means to reverse the phase of the combined output of both of the two coils of a single humbucking pickup, and a digital memory control means comprising means to recognize and store in memory a plurality of different combinations of settings for the plurality of switch means to reset the switches as necessary to achieve the recalled combination of switch settings, and means to retain the contents of the memory for an extended period of time.

9. The system of claim 8 wherein the tone control switch means comprises a plurality of capacitors, each individually selectable, in a parallel array with the capacitance of one being about twice that of the next lower valued capacitor in the array.

10. The system of claim 8 wherein the digital memory control means additionally comprises memory read/-write switch means to select either a memory read operation for selection of a particular combination of switch settings or a memory write operation to store the states of various switch means in the memory, a memory write switch means to enable the memory write operation, and a memory address switch means to select one of a plurality of switch setting combinations from the memory.

11. The system of claim 8 further comprising an internal power supply means which has at least two different current levels, one being a high current level which is enabled only when an output jack plug socket of the electric guitar is connected to an external plug, said high level current enabling the electronic actuation of the various switch means and memory storage and recall operations, and the other being a standby power level which is enabled when the output jack plug socket is disconnected, said standby power level enabling only the maintenance of the contents of the memory.

12. A system for controlling the output of a plurality of electromagnetic humbucking pickups comprising two coils per pickup of an electric guitar comprising:

a plurality of switch means responsive to both manual and electronic actuation which control the characteristics of the pickups including separate volume switches for each pickup wherein each volume switch comprises a multiple tap resistor ladder containing at least eight resistors selectably connected either individually or in combination by an analog multiplexer means such that the volume decibel level may be adjusted in non-linear increments, tone control switch means to control the frequency content of the output, overdrive switch means to enable the overloading of the input circuits of an external amplifier, switch means to disable the output of one of the two coils in a single humbucking pickup and switch means to reverse the phase of the combined output of both of the two coils of a single humbucking pickup, a digital memory control means comprising means to recognize and store in memory a plurality of different combinations of settings for the plurality of switch means, means to select and recall particular single combinations of switch settings, means to cause the generation and transmission of electronic actuation signals to the plurality of switch means to reset the switches as necessary to achieve the recalled combination of switch settings, and means to retain the contents of the memory for an extended period of time, and an internal power supply means which has at least two different current levels, one being a high level which is enabled only when an output jack plug socket of the electric guitar is connected to an external plug, said high level enabling the electronic actuation of the various switch means and memory storage and recall operations, and the other being a standby power level which is enabled when the output jack plug socket is disconnected, said standby power level enabling only the maintenance of the contents of the memory.

13. The system of claim 12 wherein the tone control switch means comprises a plurality of capacitors, each individually selectable, in a parallel array with the capacitance of one being about twice that of the next lower valued capacitor in the array.

14. The system of claim 12 wherein the digital memory control means additionally comprises memory read/write switch means to select either a memory read operation for selection of a particular combination of switch settings or a memory write operation to store the states of the various switch means in the memory, a memory write switch means to enable the memory write operation, and a memory address switch means to select one of a plurality of switch setting combinations from the memory.

* * * * *